United States Patent [19]

Hurd et al.

[11] Patent Number: 4,605,227

[45] Date of Patent: Aug. 12, 1986

[54] ATHLETE'S ARM RESTRAINER

[75] Inventors: Bruce Hurd, Ridgefield, Conn.; Robert Oda, Englewood Cliffs, N.J.

[73] Assignee: Accuswing, Incorporated, Easton, Conn.

[21] Appl. No.: 697,412

[22] Filed: Jan. 30, 1985

Related U.S. Application Data

[63] Continuation-in-part of Ser. No. 606,205, May 2, 1984, abandoned.

[51] Int. Cl.[4] ..... A63B 71/02

[52] U.S. Cl. ..... 273/54 B; 128/88; 273/189 A; 403/104

[58] Field of Search ..... 273/54 B, 189 A; 128/77, 80, 88; 403/83, 84, 90, 93, 97, 98, 104

[56] References Cited

U.S. PATENT DOCUMENTS

| | | | |
|---|---|---|---|
| 245,659 | 8/1881 | Renner | 403/90 X |
| 1,336,695 | 4/1920 | Gromes | 273/189 A |
| 2,393,142 | 1/1946 | Caron . | |
| 2,537,338 | 1/1951 | Fishbein et al. . | |
| 2,545,843 | 3/1951 | Cohan | 403/84 X |
| 2,557,604 | 6/1951 | Invidiato | 128/80 F |
| 3,439,672 | 4/1969 | Fisher | 128/88 |
| 3,698,389 | 10/1972 | Guedel | 273/54 B |
| 3,970,305 | 7/1976 | Hawkins | 273/54 B |
| 3,975,015 | 8/1976 | Owens et al. | 273/54 B |
| 4,088,318 | 5/1978 | Massman | 273/54 B |
| 4,132,407 | 1/1979 | Davis | 273/54 B |
| 4,367,872 | 1/1983 | Langston | 273/54 B |

FOREIGN PATENT DOCUMENTS

| | | | |
|---|---|---|---|
| 291547 | 6/1928 | United Kingdom | 403/90 |

*Primary Examiner*—Anton D. Oechsle
*Attorney, Agent, or Firm*—Oltman and Flynn

[57] ABSTRACT

For holding a bowler's arm rigid after it is straightened, an automatically locking hinge acts between an upper strap that is worn on the upper arm and a lower strap that is worn on the forearm. The hinge has an upper hinge structure which presents a circular peripheral surface with a detent recess at one circumferential location. The hinge has a lower hinge structure with a spring-pressed locking element that snaps into the detent recess when the arm is straightened.

8 Claims, 22 Drawing Figures

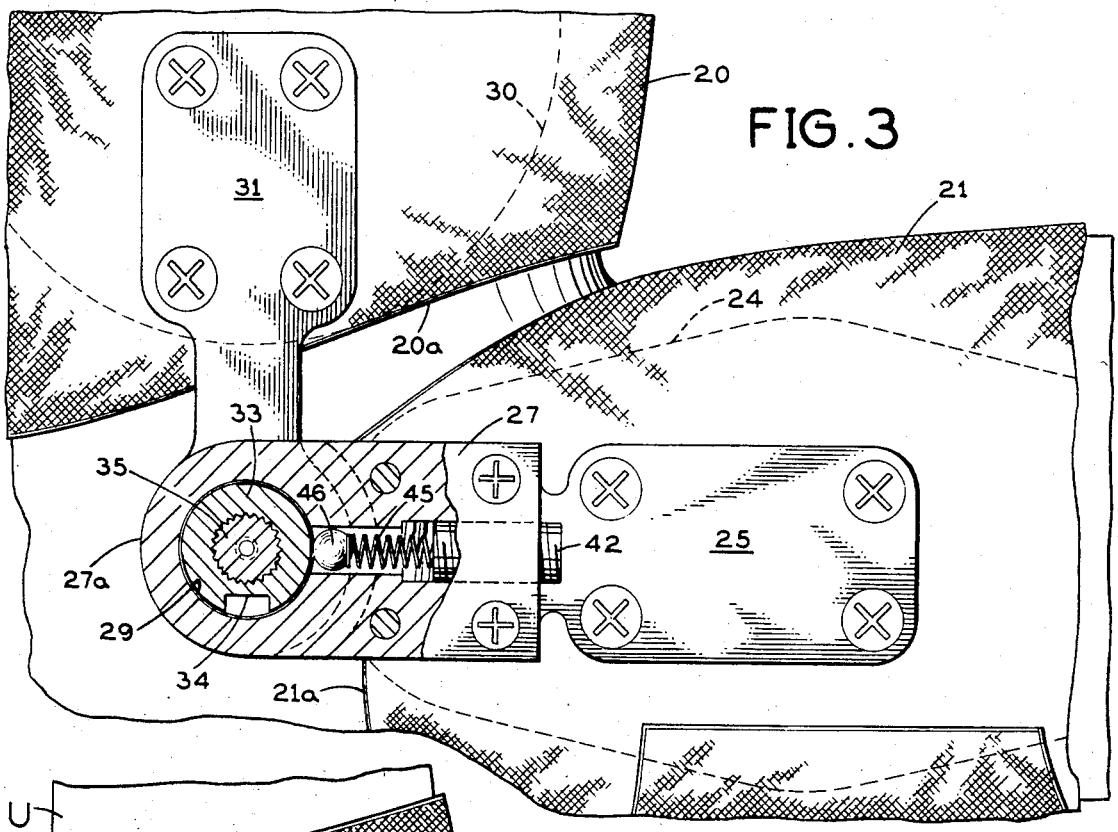
FIG. 3
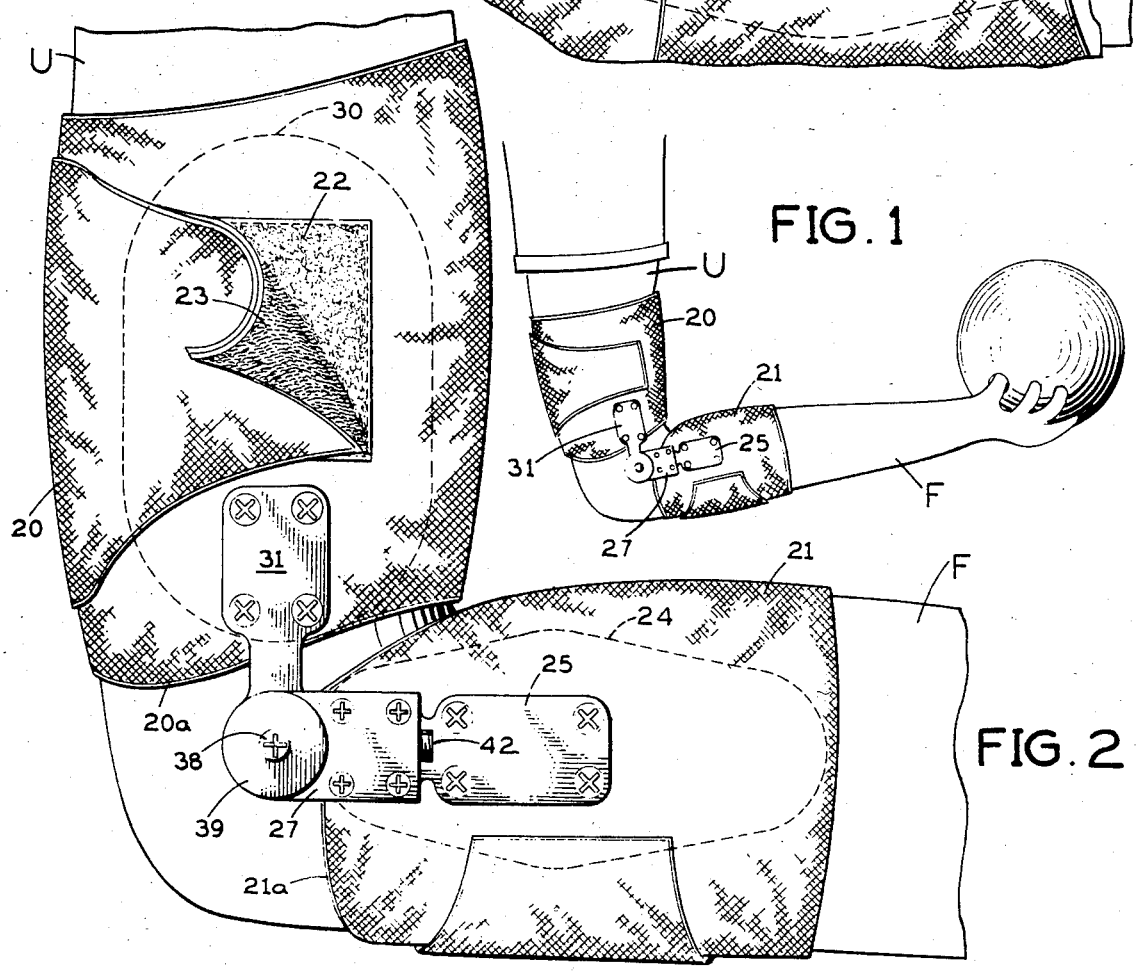
FIG. 1
FIG. 2

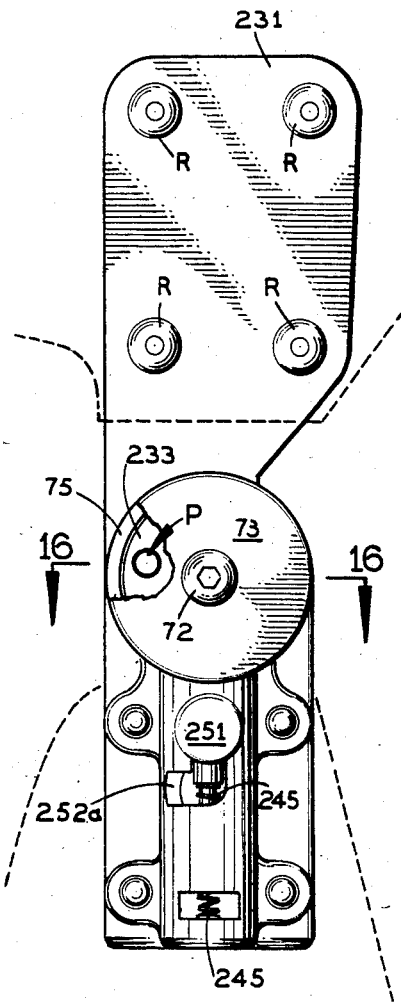
FIG. 14
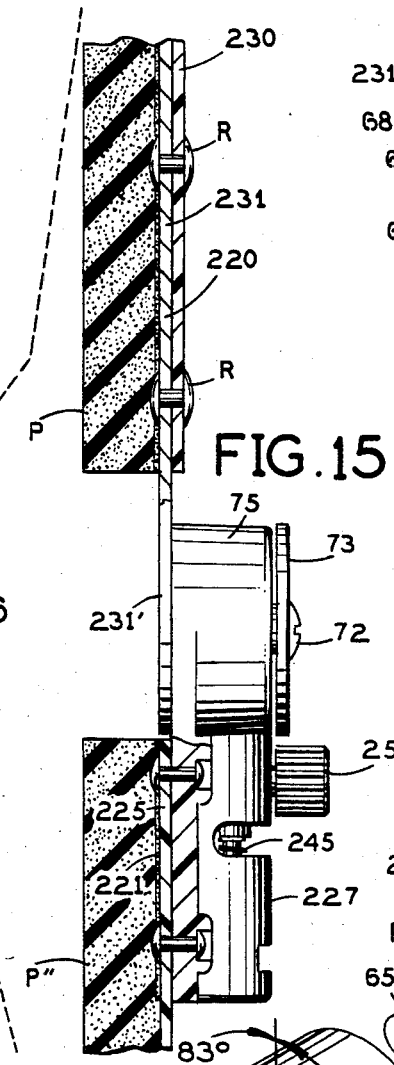
FIG. 15
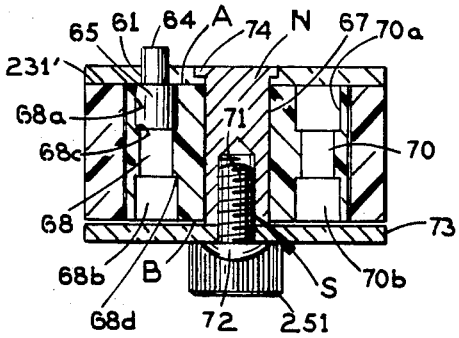
FIG. 16
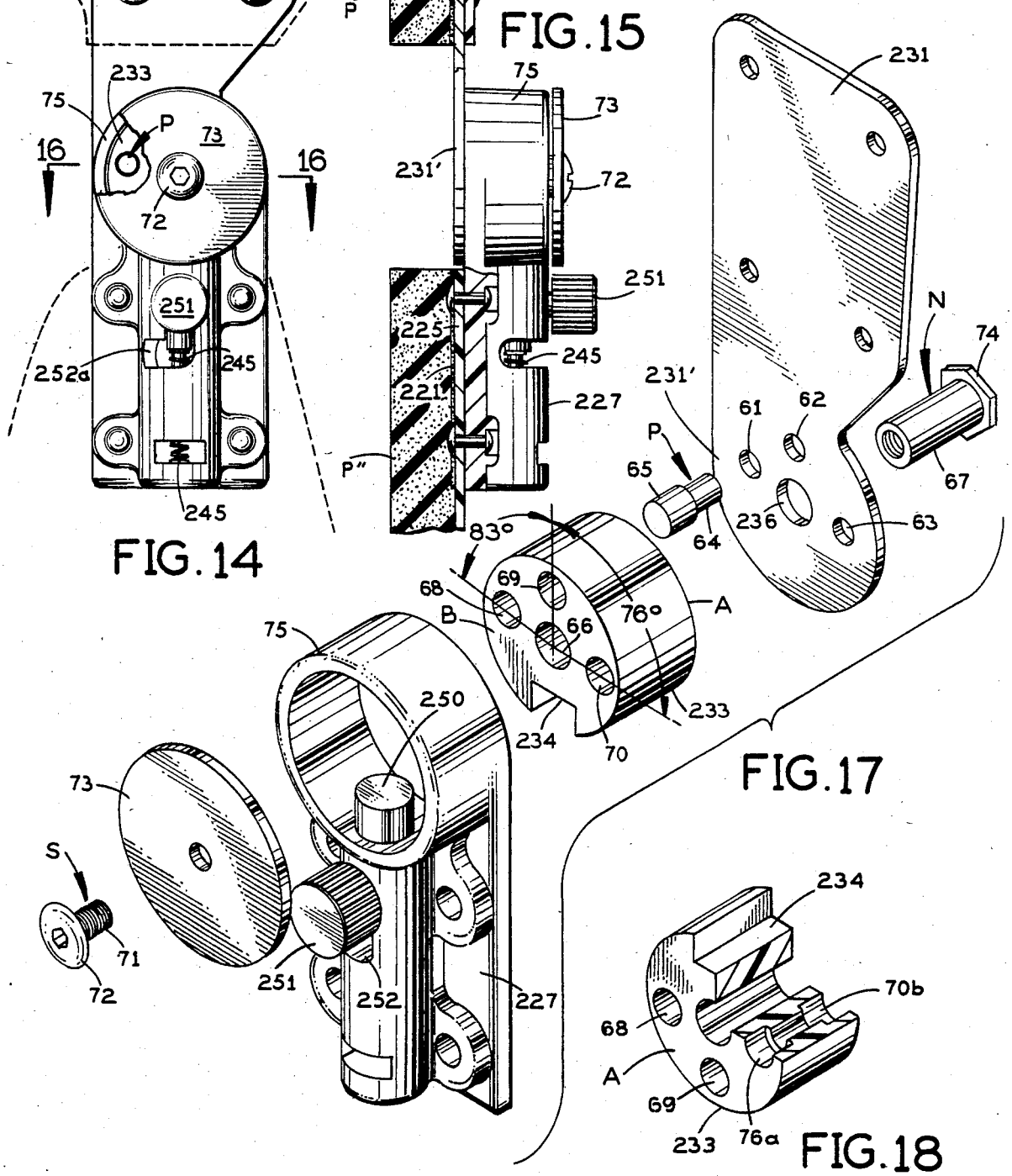
FIG. 17
FIG. 18

ATHLETE'S ARM RESTRAINER

This application is a continuation-in-part of application Ser. No. 606,205 filed May 2, 1984, abandoned.

SUMMARY OF THE INVENTION

This invention relates to an arm restrainer to be worn by an athlete to keep his or her arm substantially rigid from the shoulder down after it has been straightened.

In accordance with this invention, a strap worn on the upper arm and a strap worn on the forearm are pivotally connected by a hinge having a detent mechanism which automatically locks when the arm is straightened, so that the hinge will keep the arm rigid while it is being swung from the shoulder.

In one embodiment of the invention, the locked detent mechanism can be released by a deliberate effort of the athlete to bend that arm at the elbow.

In another embodiment of the invention the athlete must use the other hand to release the locked detent mechanism.

A principal object of this invention is to provide a novel arm restrainer to be worn by an athlete to hold his or her arm rigid while it is being swung from the shoulder.

Another object of this invention is to provide such an arm restrainer which locks automatically when the athlete straightens the arm and remains locked throughout the swinging of the arm from the shoulder unless the athlete deliberately unlocks it.

Another object of this invention is to provide such an arm restrainer for use by a bowler to hold the arm extended and rigid below the shoulder while delivering the ball.

Further objects and advantages of this invention will be apparent from the following detailed description of two presently preferred embodiments, which are shown in the accompanying drawings.

DESCRIPTION OF THE DRAWINGS

FIG. 1 is a side elevation of a bowler's arm bent at the elbow and wearing an arm restrainer in accordance with a first embodiment of the present invention;

FIG. 2 is a side elevation of an arm restrainer shown in FIG. 1 but on a larger scale;

FIG. 3 is a view similar to FIG. 2 but partly in section to show the ball detent mechanism in the hinge of the arm restrainer;

FIG. 13 shows the present arm restrainer on a bowler's arm in its successive positions during the release of the ball from the back swing to the follow through;

FIG. 14 is a side elevation of a third embodiment of this invention with parts broken away for clarity;

FIG. 15 shows this third embodiment partly in end elevation and partly in vertical cross-section;

FIG. 16 is a horizontal cross-section taken along the line 16—16 in FIG. 14;

FIG. 17 is an exploded perspective view of this third embodiment of the invention;

FIG. 18 shows the annular bushing in this embodiment in perspective and with parts broken away;

Before explaining the disclosed embodiments of the present invention in detail it is to be understood that the invention is not limited in its application to the details of the particular arrangements shown, since the invention is capable of other embodiments. Also, the terminology used herein is for the purpose of description and not of limitation.

DETAILED DESCRIPTION

Figure 5:
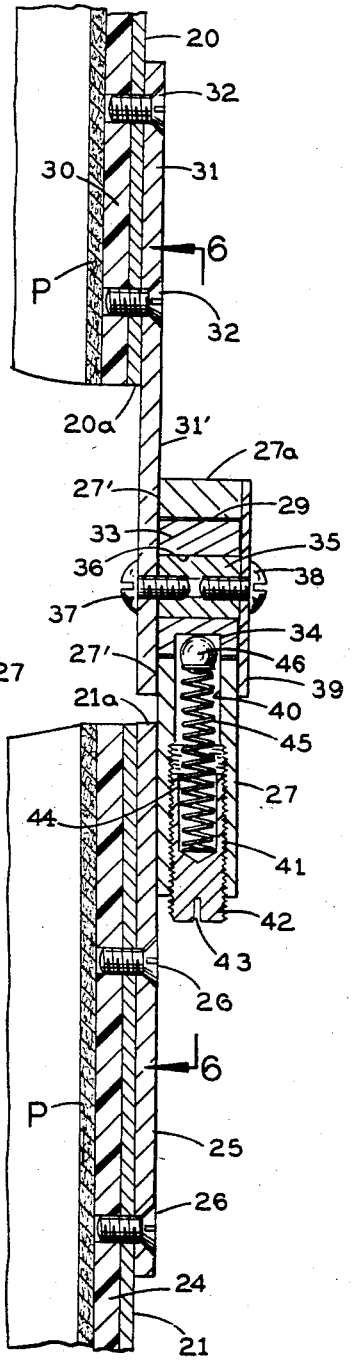
FIG. 5 is a section taken along the line 5—5 in FIG. 4 and showing the hinge of the arm restrainer locked as a result of the athlete's straightening the arm.
Figure 7:
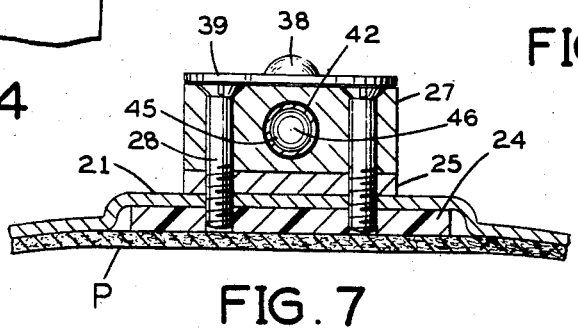
FIG. 7 is a cross-section taken along the line 7—7 in FIG. 4.

Referring first to FIG. 1, the arm restrainer of the present invention has a flexible strap 20 of any suitable material, preferably with a soft pad P on its inner face (FIG. 5). This strap can be wrapped around the upper arm U of a bowler or other athlete. The arm restrainer has a similar strap 21, which can be wrapped around the forearm F. Where each strap overlaps itself, it has "Velcro" strips, as shown in FIG. 2 at 22 and 23 for the upper arm strap 20, which engage each other to hold the strap wrapped snugly on the athlete's arm. In accordance with the present invention, the arm restrainer has a hinge connecting the forearm strap 21 to the upper arm strap 20 and acting to lock the athlete's arm rigid below the shoulder (usually with the forearm substantially aligned with the upper arm), in response to pivotal movement of the forearm to a straightened position. The hinge can be unlocked only by a deliberate conscious effort of the athlete, and in the absence of such an effort it will remain locked to hold the athlete's arm rigid.

Figure 4:
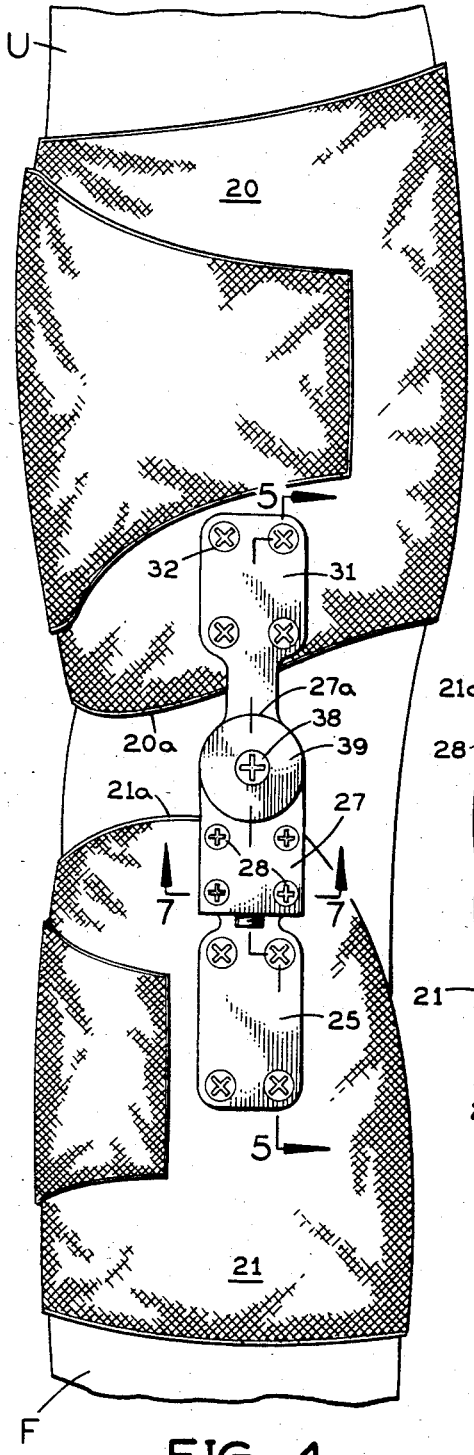
FIG. 4 is a side elevation showing the bowler's arm straightened.
Figure 6:
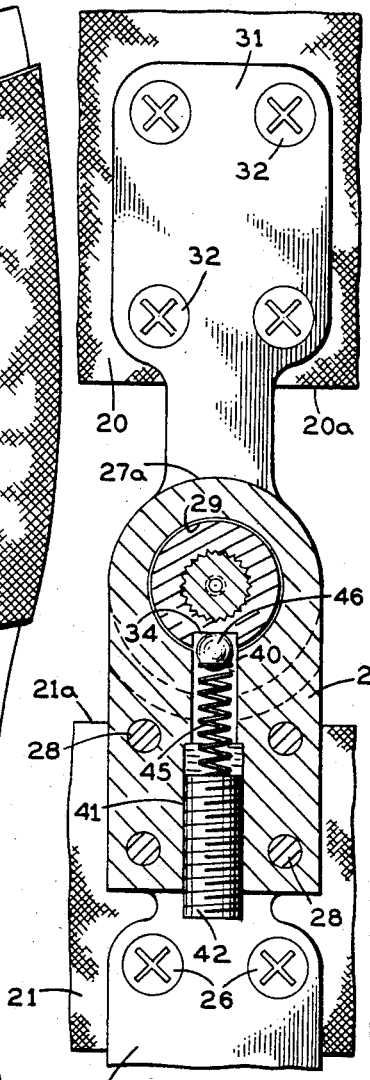
FIG. 6 is a cross-section taken along the line 6—6 in FIG. 5.

Referring to FIG. 5, the forearm strap 21 holds a flat, rigid, reinforcing plate 24 to which a flat, rigid, first hinge plate 25 is attached by screws 26. A rigid latch housing 27 is attached to the outside of hinge plate 25 by screws 28 (FIGS. 4 and 6). This latch housing extends beyond the top edge 21*a* of the forearm strap 21 and terminates in a semi-cylindrical edge 27*a*. The latch housing has a cylindrical opening 29 which is coaxial with its rounded edge 27*a*. Hinge plate 25 and latch housing 27 together constitute a rigid lower hinge structure which is located on the outside of the forearm when the forearm strap 21 is wrapped on the forearm.

As shown in FIG. 5, the upper arm strap 20 holds a flat, rigid, reinforcing plate 30 to which a flat, rigid second hinge plate 31 is attached by screws 32. Hinge plate 31 extends down past the bottom edge 20*a* of the upper arm strap 20 and its flat outer face 31′ engages the flat inner face 27′ of latch housing 27, as shown in FIG. 5.

A rigid annular bushing 33 with a cylindrical outer periphery is rotatably received in the opening 29 in latch housing 27. This bushing has a circumferentially narrow detent recess 34 (FIGS. 5 and 6) at one point along its periphery. To hold the bushing 33 in place, a bushing shaft 35 having longitudinal splines or serrations of V-shaped cross-section on the outside is snugly received in a complementary splined central opening 36 in the bushing. The inner end of bushing shaft 35 is fastened to the second hinge plate 31 by a retaining screw 37. The outer end of bushing shaft 35 is fastened by a screw 38 to a flat, rigid, retaining washer 39, which covers the outer face of bushing 33 and the neighboring area of latch housing 27.

The upper hinge plate 31, bushing 33, bushing shaft 35, washer 39, and retainer screws 37 and 38 together constitute a rigid upper hinge structure which is located on the outside of the upper arm U when the upper strap 20 is wrapped around it.

With this arrangement, the rigid lower hinge structure made up of the lower hinge plate 25 and latch housing 27 is pivotally connected to the upper hinge structure made up of elements 31, 33, 35, 37, 38 and 39.

Referring to FIGS. 5 and 6, the latch housing 27 is formed with a longitudinal bore 40 which at one end opens into its cylindrical opening 29. The opposite end of bore 40 opens into a screw-threaded counterbore 41, which threadedly receives an adjusting screw 42, the outer end of which projects beyond the latch housing and presents a cross slot 43 for receiving the tip of a screwdriver. The inner end of the adjusting screw 42 has a longitudinal recess 44 in which a coil spring 45 is seated under compression. The inner end of this spring engages a ball 46, which snaps into the detent recess 34 in bushing 33 when the upper and lower hinge plates 31 and 25 are longitudinally aligned, as shown in FIG. 6. The adjusting screw 42 is adjusted to apply enough compressive force on spring 45 that it requires a deliberated effort by the bowler to force the ball 46 out of the detent recess 34 in bushing 33 by bending his elbow.

The angular position of the lower hinge structure with respect to the upper hinge structure at which this locking action occurs can be selectively adjusted to suit an individual's preference. After removing the retaining washer 39, bushing 33 may be removed from shaft 35 and turned to a different position before reassembling these parts, so that now the detent recess 34 is at a new position. This way, the automatic locking of the hinge may take place at any selected angle between the lower and upper hinge structures. For most bowlers, this angle will be about 180 degrees but some may prefer the hinge to lock at a slightly smaller angle of the forearm with respect to the upper arm.

Figure 13:
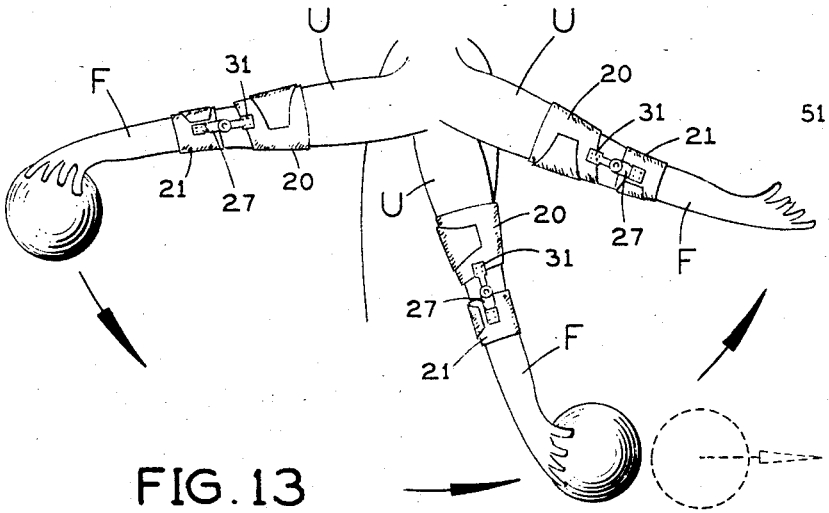

Before the bowler bowls his or her ball, he or she usually will hold the arm bent at the elbow, as shown in FIG. 1. This puts the upper hinge plate 31 at an acute angle to the latch housing 27 and lower hinge plate 25. As shown in FIG. 3, the spring-pressed ball 46 engages the cylindrical periphery of bushing 23. Before delivering the ball, the bowler will drop the arm and straighten it to some extent. Then the bowler will swing the arm back, as shown at the left of FIG. 13, before swinging it forward and down in an arc and then following through forward and upward, as shown in this Figure. Usually at some point in the backswing the bowler's arm will have straightened enough to automatically lock the hinge.

The spring-pressed ball 46 has slid along the cylindrical periphery of bushing 33 until it has reached the detent recess 34. At this point the bowler's forearm has reached the selected angular relationship with respect to the upper arm, and when ball 46 snaps into the detent recess 34 it locks the forearm in this position and keeps the arm from bending at the elbow while it moves back and up, and then down and forward to release the ball, continuing forward and up in the follow-through after the ball is released. Accordingly, the arm acts substantially as a rigid pendulum which pivots about the shoulder but not at the elbow after the hinge locks automatically.

After the arm's follow-through is completed, the bowler can by deliberate effort bend his elbow to move his forearm back to the angular position shown in FIG. 1, forcing the ball 46 out of the detent groove 34 by such effort to release the hinge lock.

In the embodiment of FIGS. 2–12, corresponding elements of the arm restrainer are given the same reference numerals plus 100 as those in the embodiment of FIGS. 1–7. Therefore, the detailed description of these elements need not be repeated.

As is evident from FIGS. 8–11, the locking ball 46 of the first embodiment is replaced by a plunger 50 whose cross-section is complementary to that of the detent recess 134 in bushing 127, so as to be snugly but slidably received in that recess. In the embodiment shown in FIGS. 8–11, this plunger and the detent recess both have a cylindrical cross-section. However, they could have any other cross-sectional shape, if desired. Because of their snugly complementary fit, once the plunger 50 snaps into the detent recess 134 the athlete cannot force it out simply by attempting to bend his elbow. Instead, the plunger 50 must be released by retracting it manually with the other hand.

Figure 8:
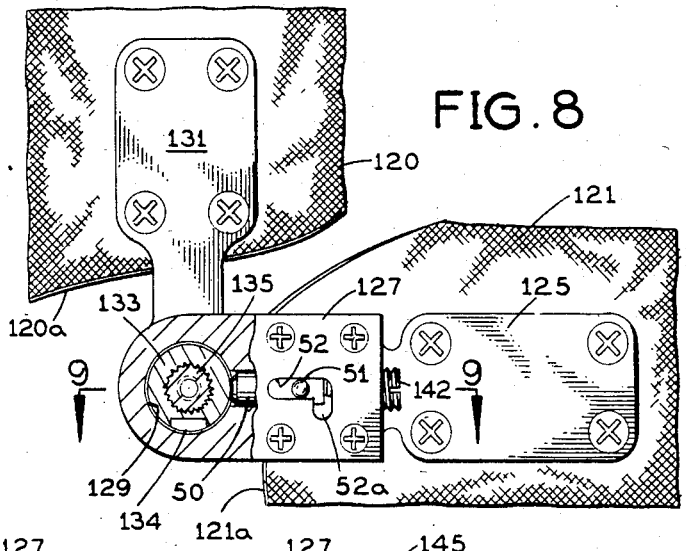
FIG. 8 is a view similar to FIG. 3 but showing a second embodiment of the present arm restrainer.
Figure 9:
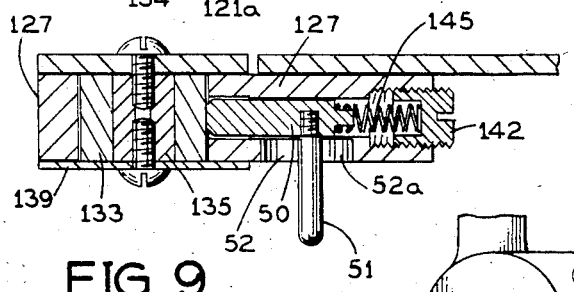
FIG. 9 is a cross-section taken along the line 9—9 in FIG. 8.
Figure 10:
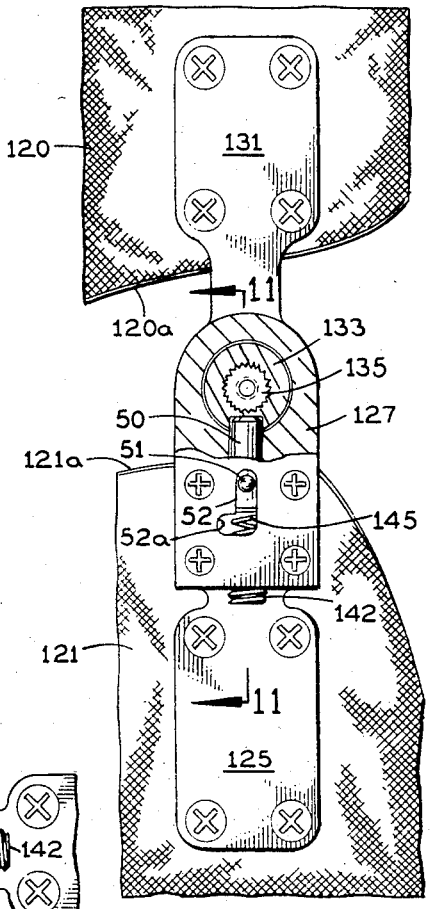
FIG. 10 shows the hinge in the arm restrainer of FIGS. 8 and 9 partly in elevation and partly in section when the athlete's arm is straightened.
Figure 12:
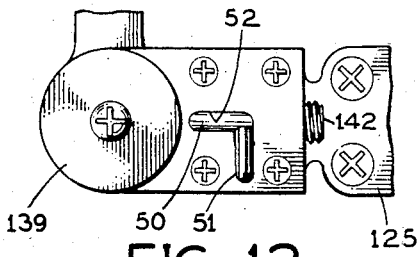
FIG. 12 is an elevational view of the hinge in this second embodiment of the invention, showing it locked against being straightened.
Figure 11:
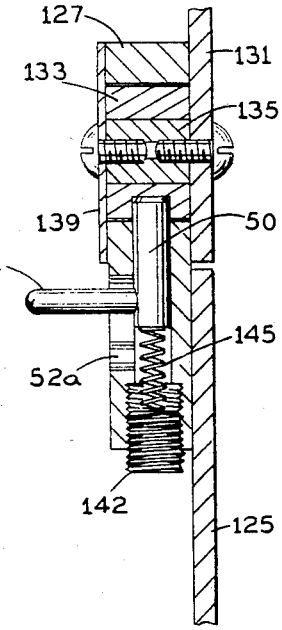
FIG. 11 is a cross-section taken along the line 11—11 in FIG. 10.

As shown in FIGS. 9 and 11, plunger 50 carries a handle 51 which extends out slidably through a slot 52 in the latch housing 127. As shown in FIGS. 8, 10 and 11, slot 52 extends longitudinally of the latch housing 127 and at its end away from the pivot axis of the hinge it terminates in a transversely offset locking notch 52*a*. The handle 51 may be slid along the slot 52, thereby releasing plunger 50 from locking engagement in the detent recess 134, and when it reaches the outer end of this slot it may be pivoted about the axis of plunger 50 enough to engage in the notch 52*a*, as shown in FIG. 12. While in this notch, it prevents the spring 145 from automatically locking the plunger 50 in the detent recess 134 when the athlete brings his or her forearm into alignment with the upper arm.

In the embodiment of FIGS. 14–22, corresponding elements of the arm restrainer are given the same reference numerals plus 200 as those in the first two embodiments. The detailed description of these elements is not repeated.

As shown in FIG. 15, the upper arm strap 220 carries a relatively thick, soft pad P′ on the inside, to which it is adhesively bonded. On the outside, except at the upper hinge plate 231, the upper arm strap 220 is adhesively bonded to a rigid reinforcing plate 230, which is curved to fit snugly behind the user's upper arm just above the elbow. The upper hinge plate 231 is sandwiched between reinforcing plate 230 and upper arm strap 220 and is fastened to them by rivets R.

Below the upper arm strap 220 the upper hinge plate 231 presents a flat extension 231' (FIG. 17) having a circular opening 236 and three smaller circular openings 61, 62 and 63 evenly spaced radially from the axis of opening 236 and equally spaced apart circumferentially 90 degrees.

A locking pin P has a smaller cylindrical end segment 64 which is snugly but slidably insertable in, and removable from, each of the openings 61, 62 and 63 in the upper hinge plate. Pin P has an opposite end segment 65, also cylindrical and of larger diameter.

The bushing 233 has a cylindrical periphery with a circumferentially narrow detent recess 234. The bushing has a central bore 66 of circular cross-section which is the same size as the opening 236 in the upper hinge plate and registers with it. A stud N has an internally screw-threaded cylindrical segment 67 which is pressed through the hinge plate opening 236 and the bushing bore 66. Bushing 233 is rotatably adjustable on the stud and is slidably removable from it to be reversed end-to-end.

Bushing 233 has three sets of circular openings at 68, 69 and 70 which are evenly spaced radially from the axis of bore 66 the same distance as the radial spacing of each opening 61, 62 and 63 in the upper hinge plate from the central opening 236. In a particular embodiment the opening 68 on the left side of the opening 69 in FIG. 17 is spaced 83 degrees from it and the opening 70 on the right side of opening 69 is spaced 76 degrees from it, and this spacing is less than either the spacing between the hinge plate openings 61 and 62 or the spacing between the hinge plate openings 62 and 63. Preferably, where the bushing openings 68 and 69 are 83 degrees apart and the bushing openings 69 and 70 are 76 degrees apart, as already mentioned, the hinge plate openings 61, 62 and 63 are 90 degrees apart.

As shown in FIG. 16 for the bushing openings 68 and 70, each opening extends completely through the bushing from one flat end face A to the opposite flat end face B. At its end face A, the bushing presents a cylindrical recess **68*a* at this end of its opening 68 which can snugly but slidably receive the larger end segment 65 of coupling pin P. Similarly, at its end face A the bushing presents a similar cylindrical recess 70*a* at this end of its opening 70 for snugly but slidably receiving the same end of the coupling pin. The bushing opening 69 has a similar cylindrical recess (not shown) at this end face A. At its opposite end face B the bushing presents identical cylindrical recesses 68*b* and 70*b* at its openings 68 and 70, as shown in FIG. 16, and a similar recess (not shown) at its opening 69. Between the recesses 68*a* and 68*b* at its opposite ends the opening 68 is slightly smaller in diameter and presents oppositely facing annular shoulders 68*c* and 68*d* against which the end of coupling pin P can seat. This is also true of the other openings 69 and 70 in bushing 233**.

Either end face, A or B, of bushing 233 may be positioned next to the upper hinge plate. FIG. 16 shows the bushing with its end face A next to the hinge plate and with the coupling pin P received in the hinge plate opening 61 and the bushing oepning 68. A clamping screw S (FIGS. 16 and 17) has a screw-threaded shank 71 threadedly engaging the internally threaded post, stud, (post) N and an enlarged head 72 holding a flat rigid washer 73 close to the adjacent end face of bushing 233. Stud N has a hexagonal head 74 (FIG. 17) which is seated in a complementary recess in the upper hinge plate 231 surrounding the opening 236. The axial length of stud N is such that it holds the washer 73 a short distance from the adjacent end face of bushing 233 when the clamping screw S is tightened.

Attached to the forearm strap 221 (FIG. 15) are a pad P" and a flat, rigid, lower hinge plate 225. A rigid latch housing 227 is riveted or otherwise ridigly attached to the front of hinge plate 225. This latch housing extends beyond the top edge of the forearm strap and presnts a cylindrical collar 75 which snugly but rotatably receives the cylindrical bushing 233.

A locking plunger 250 is slidably received in the latch housing 227 for adjustment between a locking position, in which it is received in the detent recess 234 in bushing 233, and a retracted position, in which it is disengaed from the recess. A handle 251 on plunger 256 extends out through a slot 252 in the front of latch housing 227. This slot terminates in a transversely offset locking notch **252*a* (FIG. 14) at its end away from the pivot axis of the hinge. A compression spring 245 biases plunger 250 up against the bushing 233 except when the plunger handle is in the locking notch 252*a***.

Figure 22:
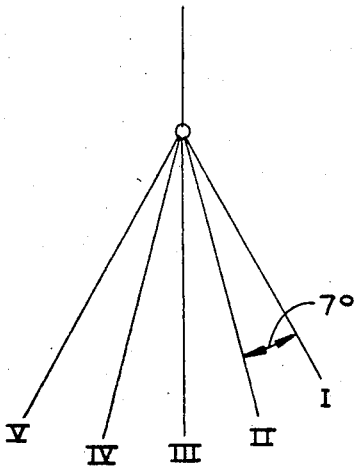
FIG. 22 is a sketch showing the five possible angular positions in which the hinge of this third embodiment can be locked when the athlete's arm is straightened, depending upon the adjustment of the FIG. 18 bushing.

Depending upon the individual user's preference, this hinge can be adjusted to lock in any selected one of five different angular positions of the lower hinge structure with respect to the upper hinge structure, as shown schematically in FIG. 22. Preferably, the different locking positions are 7 degrees apart, with position III being in the middle.

Figure 20:
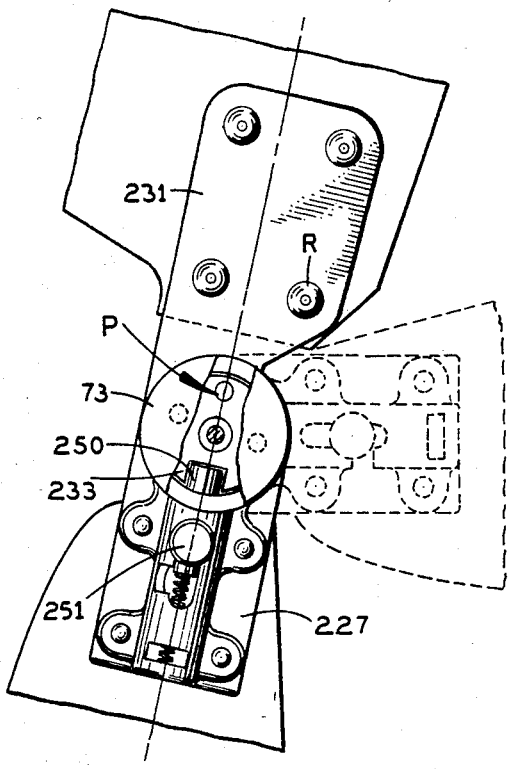
FIG. 20 is a view similar to FIG. 19 and showing the hinge locked in a second angular position.

Position III is the locking position when the middle opening 69 in bushing 233 registers with the middle opening 62 in the upper hinge plate 231 and pin P is received in these openings. Either end face A or B of bushing 233 may be next to the upper hinge plate 231 for this locking position. FIG. 20 shows the hinge locked in position III, with the upper and lower hinge structures aligned.

Figure 19:
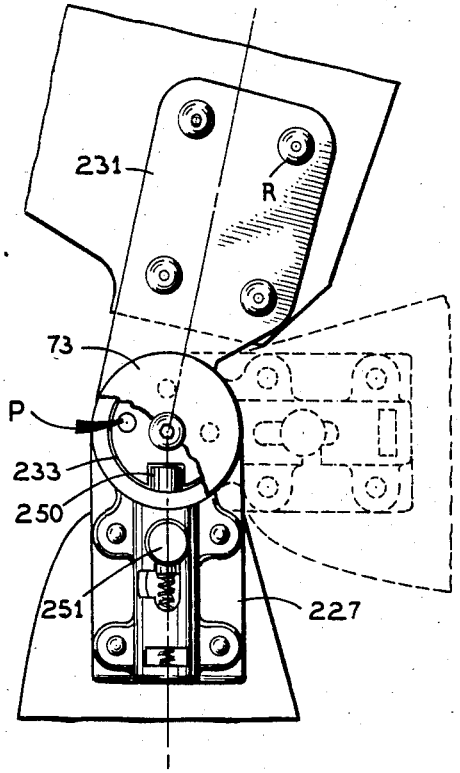
FIG. 19 is a side elevation of the hinge in this third embodiment locked in one angular position of the lower hinge member with respect to the upper hinge member.

For a right-armed bowler, when bushing 233 is positioned with its end face A next to the upper hinge plate 231:

(1) position II, shown in FIG. 19, is established when bushing opening 68 registers with opening 61 in the upper hinge plate and pin P is received in these openings; and (2) position V is established when bushing opening 70 registers with opening 63 in the upper hinge plate and pin P is received in these openings.

Figure 21:
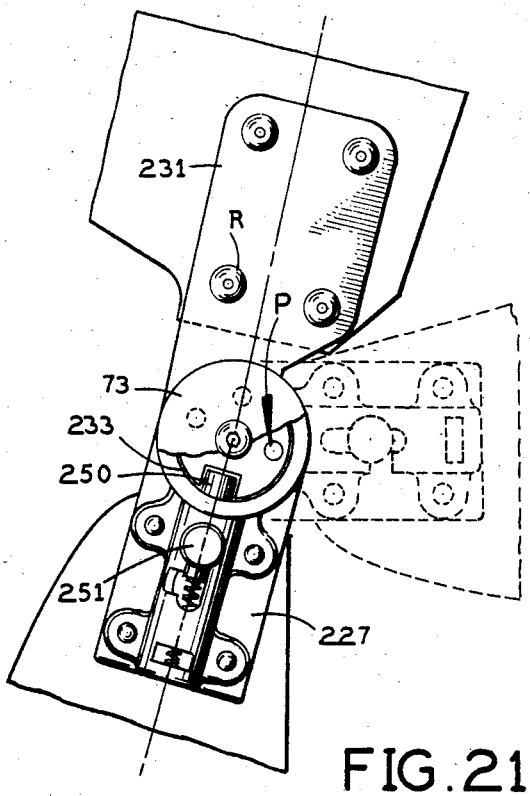
FIG. 21 is a similar view showing the hinge locked in a third angular position.

For a right-armed bowler, when bushing 233 is positioned with its end face P next to the upper hinge plate;

(1) position I is established when bushing opening 70 registers with opening 61 in the upper hinge plate and pin P is received in these openings;

(2) position IV, shown in FIG. 21, is established when bushing opening 68 registers with opening 63 in the upper hinge plate.

While the present invention has been described specifically with reference to its use by a bowler it may also be used by a golfer to keep the front arm rigid (and preferably straight) during the swing of the golf club at the ball.

I claim:

1. An arm restrainer comprising:

an upper mounting member to be worn on a person's upper arm above the elbow;

a lower mounting member to be worn on the person's forearm below the elbow;

and a hinge acting between said upper and lower mounting members and permitting the person's arm to bend at the elbow, and means in said hinge operable upon movement of the person's forearm to straighten the arm for locking said hinge to prevent the arm from bending at the elbow;

said hinge comprising:

a rigid upper hinge structure attached to said upper mounting member;

a rigid lower hinge structure attached to said lower mounting member and pivotally coupled to said upper hinge structure;

and a detent mechanism acting between said upper and lower hinge structures for automatically locking them together against further pivotal movement of one with respect to the other when they are brought into a predetermined angular relationship between one another;

one of said hinge structures having a portion with a peripheral surface which extends circularly about the pivotal axis between said upper and lower hinge structures, said one hinge structure having a detent recess at one location along said peripheral surface;

and the other of said hinge structures having a locking element slidably engageable with said peripheral surface and spring means biasing said locking element against said peripheral surface to snap into said detent recess when said locking element registers with the detent recess;

said one hinge structure comprising:

a hinge member rigidly attached to the corresponding mounting member;

a bushing member formed separate from said hinge member and having a circular periphery with said detent recess therein;

means supporting said bushing member on said hinge member for rotative adjustment about the axis of said circular periphery;

and means for selectively locking said bushing member in different rotative positions on said hinge member to thereby adjust the position of said detent recess angularly about said axis;

said hinge member having a plurality of openings evenly spaced radially from said axis at 90 degrees apart;

said bushing member having a plurality of angularly spaced openings at the same radial distance from said axis as said openings in the hinge member and each selectively registrable with a corresponding opening in the hinge member, depending upon the rotative position of said bushing member about said axis;

and said means for locking comprising a locking member snugly but slidably insertable in respective openings in said bushing member and said hinge member which register with each other.

2. An arm restrainer according to claim 1 wherein:

said angularly spaced openings in said bushing member are unequally spaced angularly, with the angular spacings between them each being different from the 90 degree angular spacing between said openings in said hinge member in said one hinge structure.

3. An arm restrainer according to claim 1 wherein:

said bushing member is reversible end-to-end with respect to said hinge member;

and said bushing member has said unequally spaced openings in its opposite ends.

4. An arm restrainer according to claim 3 wherein:

said openings in said hinge member are three openings at intervals of 90 degrees;

and said openings in said bushing member are three openings at intervals of substantially 76 degrees and 83 degrees.

5. An arm restrainer comprising:

a flexible upper strap long enough to be wrapped around a person's upper arm above the elbow;

a flexible lower strap long enough to be wrapped around the person's forearm;

a rigid upper hinge structure attached to said upper strap and extending down past said upper strap toward said lower strap;

means on said upper hinge structure near its lower end presenting a circular peripheral surface with a detent recess at one location circumferentially;

a rigid lower hinge structure attached to said lower strap and coupled to said upper hinge structure for pivoted adjustment about said circular peripheral surface on the latter, said lower hinge structure having a longitudinal bore which is open at said circular peripheral surface;

a locking member slidably mounted on said lower hinge structure at said bore and slidably engaging said circular peripheral surface;

and spring means biasing said locking member against said peripheral surface to snap into said detent recess upon a predetermined pivotal movement of said lower hinge structure;

said means presenting said circular peripheral surface being rotatably adjustable on said upper hinge structure to change the circumferential position of said detent recess and thereby change the angle between said lower and upper hinge structures at which said locking member snaps into said detent recess;

said upper hinge structure comprising a rigid upper hinge plate having a plurality of openings evenly spaced radially from the rotational adjustment axis of said means presenting said circular peripheral surface, said openings in the upper hinge plate being equally spaced angularly;

and said means presenting said circular peripheral surface being a bushing with a plurality of openings at the same radial distance from its rotational axis as said openings in the upper hinge plate, said openings in the bushing being unequally spaced apart angularly and having the angular spacings between them different from the angular spacings between said openings in said upper hinge plate;

and further comprising:

a coupling pin slidably insertable selectively in each of said openings in the upper hinge plate and in a registering opening in the bushing.

6. An arm restrainer according to claim 5 wherein:

said bushing member is reversible end-to-end with respect to said upper hinge plate;

and said bushing member has said unequally spaced openings in its opposite ends.

7. An arm restrainer according to claim 6 wherein:

said openings in said bushing member are three openings at intervals of 76 and 83 degrees;

and said openings in said upper hinge plate are three openings at intervals of substantially 90 degrees.

8. An arm restrainer comprising:

an upper mounting member to be worn on a person's upper arm above the elbow;

a lower mounting member to be worn on the person's forearm below the elbow;

and a hinge acting between said upper and lower mounting members and permitting the person's arm to bend at the elbow, and means in said hinge operable upon movement of the person's forearm to straighten the arm for locking said hinge to prevent the arm from bending at the elbow;

said hinge comprising:

a rigid upper hinge structure attached to said upper mounting member;

a rigid lower hinge structure attached to said lower mounting member and pivotally coupled to said upper hinge structure;

and a detent mechanism acting between said upper and lower hinge structures for automatically locking them together against further pivotal movement of one with respect to the other when they are brought into a predetermined angular relationship between one another;

one of said hinge structures having a portion with a peripheral surface which extends circularly about the pivotal axis between said upper and lower hinge structures, said one hinge structure having a detent recess at one location along said peripheral surface;

and the other of said hinge structures having a locking element slidably engageable with said peripheral surface and spring means biasing said locking element against said peripheral surface to snap into said detent recess when said locking element registers with the detent recess;

said one hinge structure comprising:

a hinge member rigidly attached to the corresponding mounting member;

a bushing member formed separate from said hinge member and having a circular periphery with said detent recess therein;

means supporting said bushing member on said hinge member for rotative adjustment about the axis of said circular periphery;

and means for selectively locking said bushing member in different rotative positions on said hinge member to thereby adjust the position of said detent recess angularly about said axis;

one of said members of said one hinge structure having a plurality of openings at the same radial distance from said axis and evenly spaced apart angularly about said axis;

the other of said members of said one hinge structure having a plurality of angularly spaced openings at said same radial distance from said axis and having the angular spacings between them different from the angular spacings between said openings in said one member, said openings in said other member each being selectively registrable with a corresponding opening in said one member, depending upon the rotative position of said bushing member about said axis;

and said means for locking comprising a locking member snugly but slidably insertable in respective openings in said bushing member and said hinge member which register with each other.

* * * * *